United States Patent [19]

Schuld et al.

[11] Patent Number: 4,739,535

[45] Date of Patent: Apr. 26, 1988

[54] VACUUM CLEANING MACHINE

[76] Inventors: Ernest R. Schuld; Mary A. Schuld, both of 109 Jana Rd., Macomb, Ill. 61455

[21] Appl. No.: 836,818

[22] Filed: Mar. 6, 1986

[51] Int. Cl.[4] ..... A47L 9/00

[52] U.S. Cl. ..... 15/315; 15/323; 15/327 D; 15/352

[58] Field of Search ..... 15/315, 323, 327 D, 15/352, 353

[56] References Cited

U.S. PATENT DOCUMENTS

| | | | |
|---|---|---|---|
| 956,148 | 4/1910 | Bennett | 15/327 D |
| 1,021,667 | 3/1912 | Duffie | 15/327 D |
| 2,769,997 | 11/1956 | Sheahan | 15/327 D X |
| 3,510,904 | 5/1970 | Lagerstrom | 15/319 |
| 3,619,851 | 11/1971 | Bolzan et al. | 15/315 X |
| 4,244,079 | 1/1981 | Bane | 15/315 X |
| 4,355,434 | 10/1982 | Gongwer | 15/327 R |

FOREIGN PATENT DOCUMENTS

| | | | |
|---|---|---|---|
| 271092 | 10/1950 | Switzerland | 15/315 |

*Primary Examiner*—Chris K. Moore

*Attorney, Agent, or Firm*—Trexler, Bushnell, Giangiorgi & Blackstone, Ltd.

[57] ABSTRACT

A vacuum cleaning machine for fireplaces and the like having a decorative canister enclosed in a vacuum chamber containing a fireproofed dust bag, a blower and electric motor unit and storage reels for an electric cord and a flexible vacuum hose.

17 Claims, 2 Drawing Sheets

VACUUM CLEANING MACHINE

BACKGROUND OF THE INVENTION

The present invention relates to a novel cleaning apparatus and more particularly to a novel vacuum cleaner especially suitable for cleaning fireplaces and the like.

While fireplaces in the home have been popular, the task of removing ashes and cleaning the fireplace is generally considered to be a messy and unpleasant chore. Heretofore, it has usually been necessary to use a broom and shovel to remove the ashes from the fireplace and place them in a bucket or other container for dumping at a remote location. During this operation, fine ash and dust frequently is stirred up so that it may float into the air and disperse out into the room.

SUMMARY OF THE INVENTION

It is an object of the present invention to provide a novel vacuum cleaner especially suitable for use in cleaning fireplaces whereby the task of removing dust and ash from the fireplace may be carried out quickly and cleanly and without stirring up the ash in a manner to cause it to disperse out into the room surrounding the fireplace Another object of the present invention is to provide a novel vacuum cleaner which may be used for removing ash and the like from fireplaces and which is constructed so as to substantially eliminate any danger of fire even though a live ember may be lingering in the ash.

Still another object of the present invention is to provide a novel vacuum cleaner of the above described type which is constructed so that, when not in use, it may be placed adjacent the fireplace to function as a part of the room decor without giving the appearance of being a vacuum cleaner.

A more specific object of the present invention is to provide a novel vacuum cleaner having a container in which is located an electric motor driven blower and a dust and ash collecting bag, which cleaner also includes a flexible hose removably connectable to an inlet to the bag and means within the container for receiving and storing the hose when the cleaner is not in use.

BRIEF DESCRIPTION OF THE DRAWINGS

Further objects and advantages of the present invention will become apparent from the following description and the accompanying drawings wherein.

DETAILED DESCRIPTION OF THE ILLUSTRATED EMBODIMENT

Figure 1:
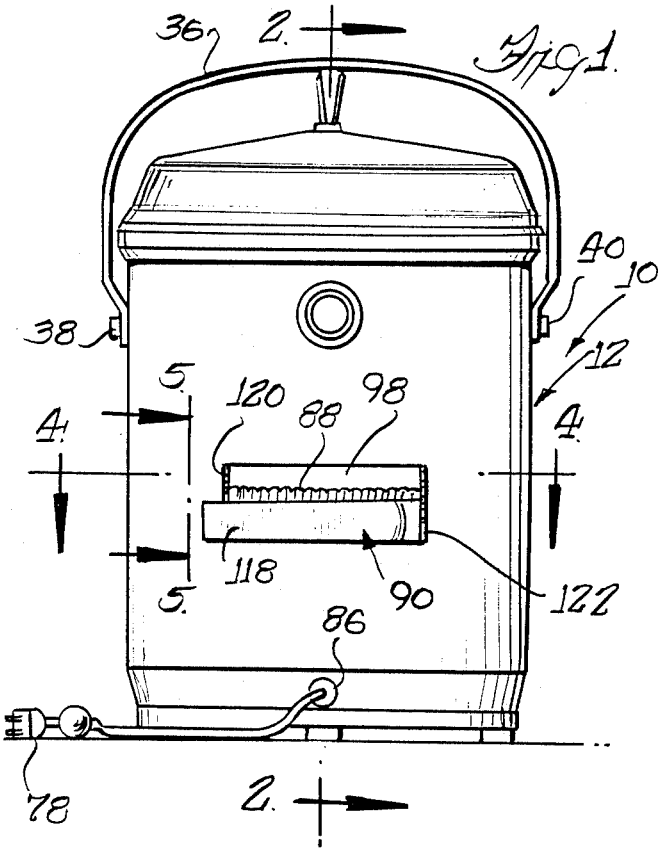
FIG. 1 is a side elevational view showing a novel vacuum cleaner incorporating features of the present invention.
Figure 2:
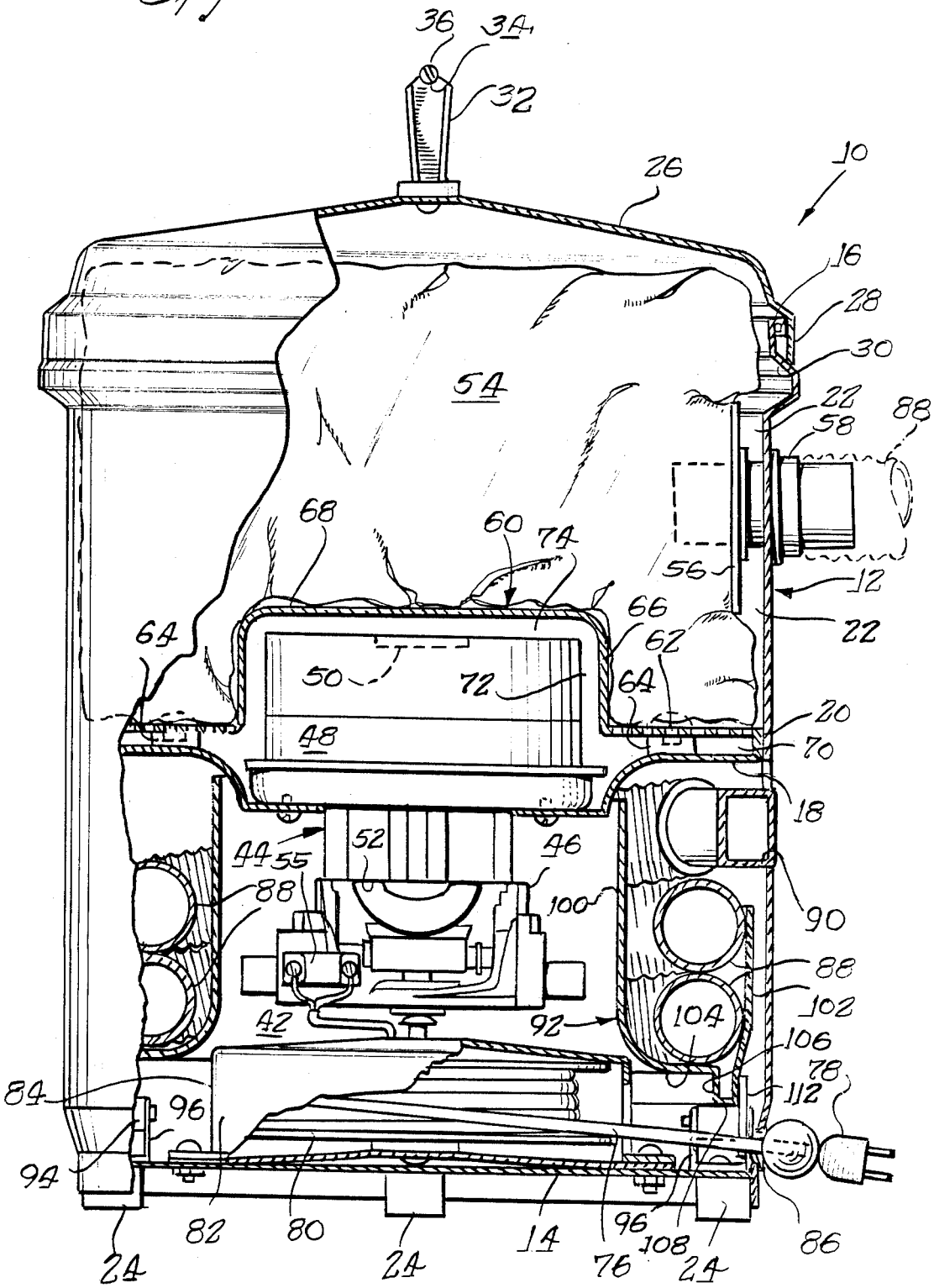
FIG. 2 is an enlarged partial sectional view taken generally along line 2–2 in FIG. 1.

Referring now more specifically to the drawings wherein like parts are designated by the same numerals throughout the various figures, a vacuum cleaner 10 incorporating features of the present invention is shown in FIGS. 1 and 2. The cleaner 10 comprises a cylindrical housing or container shell 12 having a closed bottom wall 14 and an open upper mouth defined by a rim 16. An intermediate wall or partition 18 has an annular peripheral flange 20 secured and welded or otherwise sealed to the housing 12 so as to define an upper vacuum chamber 22 within the housing. Feet 24 are secured at spaced intervals around the periphery of the bottom wall 14.

An upper end closure or lid 26 is provided for closing the upper end of the vacuum chamber 22. The lid includes a depending peripheral flange portion 28 sized to extend around the rim 16 of the housing and effectively sealingly engage an annular shoulder section 30 formed on the housing. An upstanding handle element 32 is secured to the central portion of the lid 26 to facilitate handling of the lid.

The lid handle 32 is formed with a seat 34 at its upper end for cooperative engagement with a complementary handle or bail 36 pivotally secured to opposite sides of the housing 12 by pintles 38 and 40 as shown in FIG. 1. The handle or bail 36 is formed from a stiff but resilient material such as steel and is adapted to be snapped into the seat 34 of the lid handle 32 for resiliently clamping the lid into sealing engagement with the shoulder or seat 30 on the housing. Of course the lid may be easily removed by disengaging the bail or handle 36 from the seat 34.

As indicated above, the partition 18 defines the bottom of the vacuum chamber 22 within the housing or container 12. It also defines the top of a storage chamber 42 within the lower end portion of the housing. A suction unit 44 is mounted within the housing. This unit comprises an electric motor 46 of known construction located in the chamber 42 and connected through the partition 18 with a blower 48 also of known construction in the vacuum chamber 22. The blower has an inlet 50 centrally located at an upper end thereof as shown in FIG. 2, which inlet is positioned within the vacuum chamber 22. In addition, a blower outlet 52 is located so as to discharge air into the chamber 42.

A dust and ash collecting bag 54 is positioned within the vacuum chamber 22. The bag 54 is constructed of known paper or other filtering material which is adapted to be impervious to dust and the like while permitting air to pass therethrough. The bag is secured to a cardboard or plastic member 56 having an aperture therethrough and adapted to be mounted on an inlet tube 58 secured to and passing through the wall of the housing 12 as shown in FIG. 2. In order to maximize the capacity of the cleaner, the bag 54 is shaped so as substantially to fill the entire volume of the vacuum chamber 22 including a portion thereof defined by the domed lid 26 extending above the rim 16 of the housing as shown in FIG. 2. While as indicated, the bag 54 may be formed from any known paper or other filter material, the filter material is coated or impregnated with a fire retardant substance such as well known inorganic phosphates so as to prevent the bag from catching on fire in the event a live ember is picked up with the ash during a fireplace cleaning operation. A thermally activated switch 55 of known construction is electrically connected with the motor for de-energizing the motor in response to our heating of the unit as a result of picking up an excess of live embers or in the unlikely event of a fire within the bag 54.

As indicated, the blower 48 and its inlet 50 are located directly within the vacuum chamber 22 whereby to minimize the overall size of the vacuum cleaner while allowing for maximum capacity. In order to prevent the bag from interfering with the blower and also to distribute the suction effect of the blower throughout the vacuum chamber, a baffle 60 is provided. The baffle comprises a generally horizontal annular peripheral section 62 secured in closely spaced relationship above the partition 18 by spacers 64. The annular peripheral section is secured to or merges with an upstanding cylindrical section 66 extending in spaced relationship around the side of the blower 48 and merging with a circular central section 68 which is spaced above the inlet of the blower. The top and cylindrical portions 68 and 66 of the baffle 60 are preferably solid or imperforate while the annular peripheral section 62 is perforated. With this arrangement, the suction developed by the blower is distributed more or less uniformly around the periphery of the vacuum chamber 22 and bag 54 so as to promote expansion of the bag throughout the entire volume of the chamber 22. There will be a tendency for the peripheral bottom portions of the bag to be sucked and held against the annular perforated section 62 of the baffle and this action will cause the bag to be stretched over the baffle portions 66 and 68. Since the portions 66 and 68 are imperforate or solid, the bag will slide easily over these portions as it is stretched to its expanded condition so as to insure full expansion of the bag and minimize any possibility of it being torn. In other words, the baffle 60 defines an air passageway between the vacuum chamber and the inlet of the blower, which passageway has an annular inlet 70 extending to adjacent the periphery of the housing and closed portions 72 and 74 extending around and over the blower casing to the inlet 50.

The electric motor is connected in a known manner with a length of electric cord 76 having a standard plug 78 adapted to be connected with any suitable electrical outlet in the home or building. As shown in FIG. 2, the cord 76 is wound on a reel 80 rotatably supported in a housing 82 of a spring and pawl controlled cord retracting mechanism 84 centrally secured on the bottom 14 of the storage chamber 42. The mechanism 84 may be of known construction and need not be described in detail. It suffices to state that the mechanism is such that the cord may be manually pulled from the housing through an outlet bushing 86 and will remain in the desired extended condition. However, upon the operator applying a quick tug to the cord, the built in pawl or ratchet mechanism will be released and the built in spring motor will cause the reel 80 to rotate so as to retract or wind up the cord.

The vacuum cleaner is further provided with a flexible hose 88 having one end adapted to be slipped over the inlet tube 58 projecting from the side of the vacuum chamber as shown in broken lines in FIG. 2. An opposite end of the hose is adapted to receive a nozzle 90 described more in detail below. In accordance with another feature of the present invention, means is provided within the storage chamber 42 of the housing for receiving and retaining the flexible hose when the hose is not in use. The arrangement is such that the hose and the nozzle 90 may be substantially completely enclosed within the housing 12 so as to present no unsightly appearance. This feature enables the vacuum cleaner to be used as a part of the room or fireplace decor if desired since the principal visual impression that will be presented is that of a decorative canister.

Figure 3:
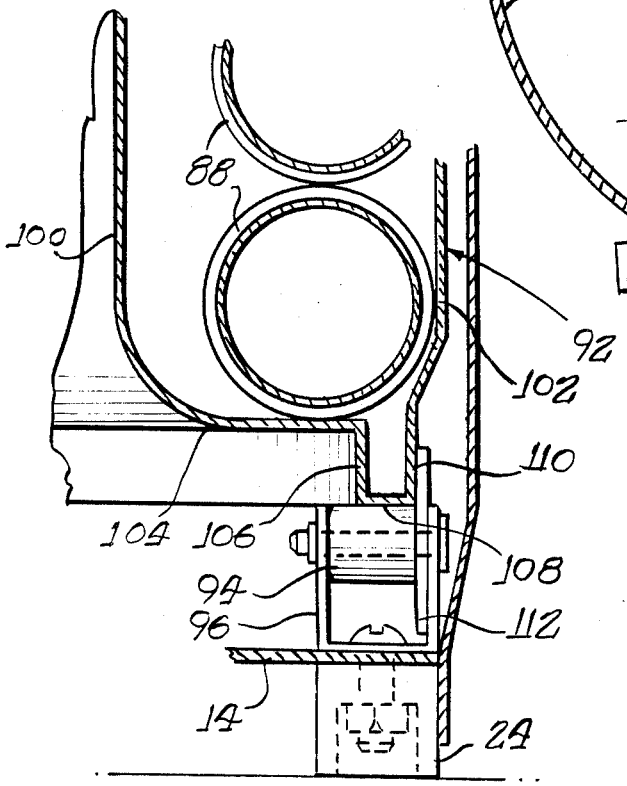
FIG. 3 is a further enlarged fragmentary sectional view showing a lower right hand corner portion of FIG. 2 in greater detail.

Referring now more specifically to FIGS. 2 and 3, it is seen that the means for receiving and storing the flexible hose comprises a reel or drum 92 mounted for rotation about a vertical axis in a position surrounding the electric motor 46. Three or more rollers 94 are mounted by brackets 96 secured to the bottom 14 at points generally equally spaced around the housing for rotatably supporting the drum or reel 92. It will be noted that the diameter of the hose reel is greate than the diameter of the reel mechanism for the electric cord so that the supporting rollers 94 are located in the lower end of the housing around the periphery of the electric cord reel mechanism 84.

Figure 4:
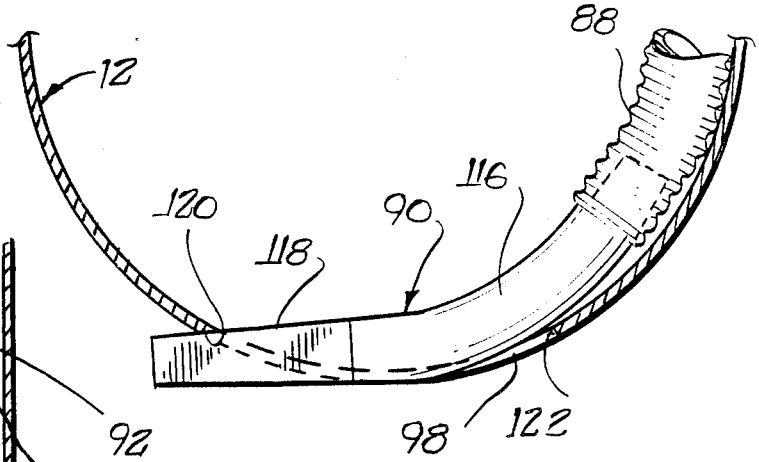
FIG. 4 is a fragmentary partial sectional view on an enlarged scale taken along line 4—4 in FIG. 1.

As shown in FIGS. 1, 2 and 4, an opening 98 is formed in the side of the housing 12 through which the hose may be inserted and retracted. It should also be noted that the opening 98 provides an exhaust port for the air which is delivered to the storage chamber 42 from the blower 48. The opening 98 is located adjacent the upper end of the storage chamber 42 and well above a lower margin of the drum or reel 92. As shown in FIG. 2, the hose reel 92 has a cylindrical inner wall 100, a cylindrical outer wall 102 spaced from the inner wall a distance greater than the diameter of the tube 88, which inner and outer walls are joined by a bight portion 104 whereby to provide the reel with a generally U-shaped cross-sectional configuration. At the junction between the bight portion 104 and the outer reel wall 102, the hose reel is formed with an annular bearing section 106 having a flat bottom 108 adapted to ride on the rollers 94 and a vertical peripheral section 110 adapted to engage flanges 112 on the rollers. With this arrangement, it is seen that the rollers 94 will support the hose reel or drum for free rotation and the flanges 112 of the roller will maintain the drum in a position centered about the axis of the electric motor.

Referring particularly to FIG. 2, it is seen that the inner wall 100 of the hose reel or drum extends substantially to the top of the storage chamber 42 and well above the lower edge of the opening or port 98. However, the outer wall 102 of the reel or drum extends upwardly only to about the level of the lower edge of the opening 98. With this arrangement, the hose may be easily coiled upon the drum or reel by initially inserting an end through the opening 98 until it is directed around the interior of the housing by the inner wall 100 of the reel. The entering end of the hose will then fall toward the bottom or bight portion 104 of the reel where it will be trapped between the walls 100 and 102. Then, as the operator continues to push the hose inwardly through the opening 98, the reel will turn and the hose will be coiled thereon as indicated in FIG. 2.

Figure 5:
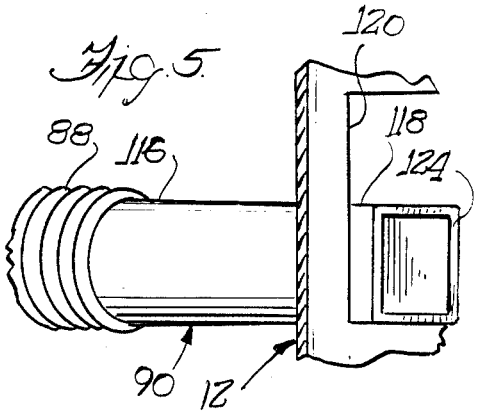
FIG. 5 is an enlarged end view of a nozzle member of the vacuum cleaner as seen from line 5—5 in FIG. 1.

As shown in FIGS. 1 and 4, the hose may be coiled within the housing until only a small portion of the tip of the nozzle 90 projects outwardly. This arrangement enhances the appearance of the unit when it is not in use. It is further to be noted that the nozzle 90 is formed and related to the curvature of the housing wall 12 and the width of the opening 98 so as effectively to prevent the nozzle from being pushed all the way into the interior of the housing. This arrangement assures that there will always be a sufficient portion of the nozzle tip protruding so that it may be easily grasped by a user when it is desired to pull the hose out of the housing. More specifically, as shown best in FIG. 4, the nozzle is formed with a first curved portion 116 which is shaped to form a "pistol grip" whereby to facilitate handling of the nozzle during a cleaning operation. In addition, the nozzle is formed with a straight but tapered tip portion 118. The arrangement is such that when the nozzle is pushed into the opening 98, it will ultimately bind against opposite end edges 120 and 122 of the opening as shown in FIG. 4 so as to restrain it from being pushed all the way into the housing. As shown in FIG. 5, the straight tapered tip portion 118 of the nozzle is preferably formed with an end margin 124 having a rectangular configuration with straight sides. Such straight sides may be used for more effective engagement and scraping of fireplace surfaces for removal of any ash which may be stuck thereto.

The operation of the vacuum cleaner of the present invention is believed to be clear from the above description and need only be briefly summarized. When it is desired to use the machine, the flexible hose is first pulled from the storage chamber 42 and assembled over the inlet tube 58. It is assumed that a bag 54 which is, of course, removable, has already been assembled in the vacuum chamber. The electric cord is then pulled from the storage chamber and connected with a suitable electric outlet. Then, the ashes and other debris may be easily and cleanly removed from the fireplace by manipulating the nozzle 90 through an ash pile and along the fireplace surfaces. While the use of the machine for cleaning fireplaces has been emphasized herein, it is to be understood that the machine can also be used for other related purposes such as cleaning Franklin stoves, charcoal grills and the like.

It is further to be understood that while a preferred embodiment of the present invention has been shown and described herein, many changes and modifications may be made without departing from the spirit and scope of the appended claims.

The invention is claimed as follows:

1. A vacuum cleaning machine comprising an upstanding cylindrical housing means defining an upper vacuum chamber and a lower storage chamber, inlet means through said cylindrical housing means and connected with said vacuum chamber, a dust bag disposed in said vacuum chamber and connected with said inlet means, a blower mounted in said housing means and having an air inlet communicating with said vacuum chamber and an outlet communicating with said storage chamber, an electric motor centrally disposed in said storage chamber and drivingly connected with said blower, an electric supply cord electrically connected with said motor, first reel means disposed in said storage chamber, said cord being wound and stored on said first reel means, a flexible vacuum hose, and second reel means rotatably mounted in said storage chamber, opening means in a side-wall in said housing means for enabling said hose to be inserted into and removed from said storage chamber, said opening means also functioning as an air exhaust port for said storage chamber, said flexible hose being wound on and stored on said second reel means substantially completely within said housing when not in use and surrounding said electric motor, and said hose being removable from said second reel means and connectable to said inlet means when said machine is to be used.

2. A vacuum cleaning machine, as defined in claim 1, wherein said blower inlet is centrally disposed within said vaccum chamber, said machine including baffle means defining an air passageway between said vacuum chamber and said blower air inlet, said baffle means comprising a peripheral portion containing air inlet perforations and imperforate portions between said air inlet perforations and said blower air inlet for effectively applying suction from the blower primarily to peripheral portions of the vacuum chamber and bag.

3. A vacuum cleaning machine, as defined in claim 2, wherein said housing means comprises a partition separating said vacuum chamber and said storage chamber, said blower being disposed in said vacuum chamber at one side of said partition, said baffle means being mounted with its perforated peripheral portion close to but spaced from said partition and said imperforate portions of said baffle means extending axially from said peripheral portion around and over said blower.

4. A vacuum cleaning machine, as defined in claim 1, wherein said dust bag is formed from dust filtering material, said dust bag containing a fire retardant material whereby said machine is especially adapted for cleaning fireplaces and the like.

5. A vacuum cleaning machine, as defined in claim 4, which includes thermal switch means connected with said motor and responsive to elevated temperatures for de-energizing said motor in the event a fire occurs within the machine.

6. A vacuum cleaning machine, as defined in claim 1, wherein said housing means comprises a generally cylindrical side wall having an open upper end and a lid removably covering said open upper end, said machine including a resilient handle bail having opposite ends pivotally connected to diametrically opposite areas of said side wall, said bail being adapted to extend over said lid, and handle means on said lid, said handle means including seat means engageable with said bail when the bail is positioned over the lid for enabling the bail clampingly to retain the lid on the cylindrical wall of the housing means.

7. A vacuum cleaning machine, as defined in claim 1, wherein said second reel means comprises inner and outer cylindrical walls spaced apart for receiving the hose therebetween and joined by a bottom annular bight portion, said inner wall extending in overlapping relationship with respect to said opening means for guiding the vacuum tube onto said second reel means when the tube is being inserted through said opening means for storage, said outer wall having a free edge terminating so as to avoid obstructing said opening means.

8. A vacuum cleaning machine, as defined in claim 7, which includes a nozzle connected with an outer end of said hose, said nozzle having a configuration different from that of said housing means and said second reel means and being sized with respect to said opening means for engagement with edges of the opening means and thus preventing the nozzle from passing entirely through the opening means into said storage chamber.

9. A vacuum cleaning machine, as defined in claim 8, wherein said nozzle comprises substantially straight terminal edge means for facilitating use of the nozzle as a scraper during a cleaning operation.

10. A vacuum cleaning machine comprising an upstanding cylindrical housing, a lid removably closing an upper end of said housing, a partition traversing said housing and defining therewith a vacuum chamber, inlet means through said housing into said vacuum chamber, said inlet means being connectable to a dust bag when the bag is assembled within the vacuum chamber, a blower mounted in said housing and having an air inlet disposed centrally of said housing and above said partition, and baffle means mounted in said vacuum chamber, said baffle means including an annular peripheral portion defining air inlet passageway means adjacent said cylindrical housing, said baffle means further including imperforate portions extending from said last mentioned inlet passageway means over said blower inlet for effectively applying suction from said blower to peripheral portions of the vacuum chamber.

11. A vacuum cleaning machine, as defined in claim 10, wherein said partition also defines with said cylindrical housing a storage chamber beneath said vacuum chamber, said machine further including an electric motor centrally located in said storage chamber and drivingly connected with said blower, an electric supply cord electrically connected with said motor, a first storage reel for said electric supply cord mounted within a lower end portion of said cylindrical housing and having a diameter substantially less than the cylindrical housing, a flexible vacuum hose, and a second reel means rotatably disposed in said storage chamber around said electric motor and removably storing said hose.

12. A vacuum cleaning machine, as defined in claim 11, which includes roller means mounted within a lower end portion of said cylindrical housing at a location surrounding said first mentioned reel means, said roller mean rotatably supporting said second mentioned reel means.

13. A vacuum cleaning machine comprising an upstanding cylindrical housing, a lid removably closing an upper end of said housing, a partition traversing said housing and defining therewith an upper vacuum chamber and a lower storage chamber, inlet means through said housing into said vacuum chamber, a flexible vacuum hose removably connectable with said inlet means, said inlet means being connectable to a dust bag when the bag is assembled within the vacuum chamber, a blower mounted in said housing and having an air inlet communicating with said vacuum chamber, an electric motor mounted in said housing and drivingly connected with said blower, opening means through said cylindrical housing and communicating with said storage chamber for enabling said hose to be inserted into said storage chamber when the hose is removed from said inlet means, and hose reel means rotatably mounted within said storage chamber for receiving and storing said hose.

14. A vacuum cleaning machine, as defined in claim 13, wherein said hose reel means comprises inner and outer walls spaced apart for receiving said hose therebetween and having lower margins joined by an annular bight portion, said inner wall being disposed with respect to said opening means for guiding an end of the hose into the storage chamber during insertion of the hose into the storage chamber, said outer wall having an upper free edge disposed for avoiding obstruction of said opening means, and roller means mounted at spaced intervals around a lower end of said storage chamber for rotatably supporting said hose reel means.

15. A vacuum cleaning machine comprising housing means defining a vacuum chamber and a storage chamber, inlet means connected with said vacuum chamber, a dust bag disposed in said vacuum chamber and connected with said inlet means, a blower mounted in said housing means and having an air inlet communicating with said vacuum chamber and an outlet communicating with said storage chamber, said blower air inlet being centrally disposed within said vacuum chamber, said machine including baffle means defining an air passageway between said vacuum chamber and said blower air inlet, said baffle means comprising a peripheral portion containing air inlet perforations and imperforate portions between said air inlet perforations and said blower air inlet for effectively applying suction from the blower primarily to peripheral portions of the vacuum chamber and bag, an electric motor mounted in said storage chamber and drivingly connected with said blower, an electric supply cord electrically connected with said motor, first reel means disposed in said storage chamber, said cord being wound and stored on said first reel means, a flexible vacuum hose, and second reel means rotatably mounted in said storage chamber, said flexible hose being wound on and stored on said second reel means substantially completely within said housing when not in use, and said hose being removable from said second reel means and connectable to said inlet means when said machine is to be used.

16. A vacuum cleaning machine comprising housing means having a generally cylindrical side-wall having an open upper end and a lid removably covering said open upper end, said machine including a resilient handle bail having opposite ends pivotally connected to diametrically oppposite areas of said side-wall, said bail being adaptd to extend over said lid, and handle means on said lid, said handle means including seat means engageable with said bail when the bail is positioned over the lid for enabling the bail clampingly to retain the lid on the cylindrical wall of the housing means, said housing means defining a vacuum chamber and a storage chamber, inlet means connected with said vacuum chamber, a dust bag disposed in said vacuum chamber connected with said inlet means, a blower mounted in said housing means and having an air inlet communicating with said vacuum chamber and an outlet communicating with said storage chamber, an electric motor mounted in said storage chamber and drivingly connected with said blower, an electric supply cord electrically connected with said motor, first reel mean disposed in said storage chamber, said cord being wound and stored on said first reel means, a flexible vacuum hose, and second reel means rotatably mounted in said storage chamber, said flexible hose being wound on and stored on said second reel means substantially completely within said housing when not in use, and said hose being removable from said second reel means and connectable to said inlet means when said machine is to be used.

17. A vacuum cleaning machine comprising housing means defining a vacuum chamber and a storage chamber, inlet means connected with said vacuum chamber, a dust bag disposed in said vacuum chamber and connected with said inlet means, a blower mounted in said housing means and having an air inlet communicating with said vacuum chamber and an outlet communicating with said storage chamber, an electric motor mounted in said storage chamber and drivingly connected with said blower, an electric supply cord electrically connected with said motor, first reel means disposed in said storage chamber, said cord being wound and stored on said first reel means, a flexible vacuum hose, and second reel means rotatably mounted in said storage chamber, said flexible hose being wound on and stored on said second reel means substantially completely within said housing when not in use, said hose being removable from said second reel means and connectable to said inlet means when said machine is to be used, said second reel means having inner and outer cylindrical walls spaced apart for receiving the hose there between and joined by a bottom annular bight portion, said inner wall extending in overlapping relationship with respect to said opening means for guiding the vacuum tube onto said second reel means when the tube is being inserted through said opening means for storage, said outer wall having a free edge terminating so as to avoid obstructing said opening means.

* * * * *